US009598829B2

(12) United States Patent
Betts

(10) Patent No.: US 9,598,829 B2
(45) Date of Patent: Mar. 21, 2017

(54) SNOWBLOWER SKID SHOE HEIGHT ADJUSTMENT MECHANISM

(71) Applicant: Deere & Company, Moline, IL (US)

(72) Inventor: Russell J. Betts, Waterloo, IA (US)

(73) Assignee: DEERE & COMPANY, Moline, IL (US)

( * ) Notice: Subject to any disclaimer, the term of this patent is extended or adjusted under 35 U.S.C. 154(b) by 0 days.

(21) Appl. No.: 14/453,076

(22) Filed: Aug. 6, 2014

(65) Prior Publication Data

US 2016/0040380 A1 Feb. 11, 2016

(51) Int. Cl.
*E01H 5/09* (2006.01)

(52) U.S. Cl.
CPC ..... *E01H 5/098* (2013.01)

(58) Field of Classification Search
CPC ... A01H 5/04; A01H 5/08; A01H 5/09; A01H 5/098
USPC ..... 56/17.2
See application file for complete search history.

(56) References Cited

U.S. PATENT DOCUMENTS 1,730,817 A * 10/1929 Gyllenkrook ..... E01H 5/066 37/271
2,700,857 A * 2/1955 Stearman ..... A01D 46/10 56/10.2 E
2,768,453 A 10/1956 Adams, Jr.
3,490,057 A 1/1970 Kahlbacher
3,721,025 A 3/1973 Orr
4,441,266 A 4/1984 Westimayer
4,825,956 A * 5/1989 Kanato ..... A01B 59/043 172/2
4,940,096 A * 7/1990 Johnson ..... B66F 9/065 172/443
5,813,152 A * 9/1998 Weight ..... E01H 5/08 37/249
6,508,018 B1 1/2003 O'Brien
7,395,648 B1 * 7/2008 Silbernagel ..... A01D 34/54 56/17.2
7,540,102 B2 6/2009 Olmr et al.
7,607,283 B2 * 10/2009 Wright ..... A01D 34/74 56/17.1
8,096,374 B1 * 1/2012 Papke ..... A01D 34/82 180/19.3
8,104,552 B2 * 1/2012 Papke ..... A01D 34/82 180/19.3
8,191,289 B2 6/2012 Raftery
8,371,095 B2 * 2/2013 Grewe ..... A01D 34/67 56/17.1
8,544,856 B2 10/2013 Sayre
8,584,383 B1 11/2013 Morse et al.
8,732,988 B2 5/2014 Hanson
(Continued)

*Primary Examiner* — Robert Pezzuto
*Assistant Examiner* — Joan D Misa

(57) ABSTRACT

A snowblower skid shoe height adjustment mechanism includes a linear actuator mounted to an auger housing. The linear actuator may be connected to a switch in an operator station. A shaft extends transversely across the auger housing and rotates in response to the extension or retraction of the linear actuator. A first bell crank is attached to a left end and a second bell crank is attached to a right end of the shaft. A rod is connected to each of the first and the second bell cranks, and each rod extends generally vertically down to a skid shoe. The rods and skid shoes are raised or lowered as the linear actuator is extended or retracted.

10 Claims, 2 Drawing Sheets

(56) References Cited

U.S. PATENT DOCUMENTS

| | | | | |
|---|---|---|---|---|
| 2005/0066553 | A1 | 3/2005 | Light | |
| 2006/0237240 | A1 * | 10/2006 | Crumly ..... | A01D 34/6806<br>180/6.48 |

* cited by examiner

SNOWBLOWER SKID SHOE HEIGHT ADJUSTMENT MECHANISM

FIELD OF THE INVENTION

This invention relates to snowblowers, and specifically to a snowblower skid shoe height adjustment mechanism.

BACKGROUND OF THE INVENTION

Snowblowers are designed to lift snow off the ground surface and blow the snow away from the area being cleared. Single stage snowblowers may include a scraper to lift or scrape snow from the surface, and an impeller that moves the snow up and out through a discharge chute. Two stage snowblowers include a metal auger that rotates on a horizontal axis to break up and draw snow into the housing where the impeller then forces it up and out the discharge chute.

Snowblowers may be walk behind or mounted to the front of a small tractor or utility vehicle using a hitch. A hydraulic cylinder controlled by the operator may be used to raise and lower the hitch, and another to change the angle of the discharge chute. A power take off shaft (PTO) may be connected to the snowblower to rotate the auger and/or impeller.

Snowblowers may be provided with skid shoes mounted adjacent the lower edge of each side wall of the auger housing. The skid shoes may have a bottom surface that allows them to slide over the ground surface, keeping the bottom edge of the auger housing and scraper a short distance above the ground surface, and preferably at least about ½ inch above the ground surface. Skid shoes may help prevent or minimize damage to the housing or other components of the snowblower, and to avoid bringing material other than snow into the snowblower. For example, snowblowers may encounter various different ground surfaces having different surface conditions other than cement, such as gravel, dirt, or grass. It would be desirable to raise or lower a snowblower when encountering different surface conditions, to prevent damage to snowblower components and to prevent material other than snow from entering the housing and blowing out the discharge chute.

Conventional snowblowers do not provide an acceptable solution to this problem. It is inconvenient and difficult to adjust the height of skid shoes by loosening and changing the position of several bolts or attachment mechanisms holding each shoe or skid to the housing. This is a problem when the skid shoes are covered with snow and ice. Examples of these skid shoe mechanisms are shown in U.S. Pat. Nos. 2,768,453 and 4,441,266. Conventional snowblowers also may be raised or lowered using the hydraulic lift cylinder. However, adjusting the snowblower using a lift cylinder may sacrifice good and uniform performance because the lift cylinder raises the back of the snowblower and changes the angle of approach. Some conventional snowblowers also have proposed replacing the skid shoes with rollers or caster wheels. However, rollers or caster wheels may be useful on dry or bare surfaces, but do not work as well on snow and ice. Additionally, the height of rollers or caster wheels cannot be adjusted in winter conditions without facing the same problems as skid shoes. Examples of rollers or caster wheels are shown in U.S. Pat. Nos. 3,721,025, 6,508,018 and 8,191,289. Finally, a mechanism with a pair of turning handles was proposed in U.S. Pat. No. 3,490,057. However, each handle is connected to the spindle of a disk, the spindles are threaded to casings connected to the housing, and both handles must be turned the same to keep the machine level.

A snowblower skid shoe height adjustment mechanism is needed that can simultaneously raise or lower a pair of skid shoes in winter conditions while the operator remains in the operator station.

SUMMARY OF THE INVENTION

A snowblower skid shoe height adjustment mechanism includes an electrically powered linear actuator mounted to an auger housing, and a linkage between the linear actuator and a pair of skid shoes adjacent a pair of sidewalls of the auger housing. The linkage includes a shaft extending transversely across the auger housing connected to a pair of vertically oriented rods. An electrical switch in an operator station is connected to the linear actuator.

DESCRIPTION OF THE PREFERRED EMBODIMENT

Figure 1:
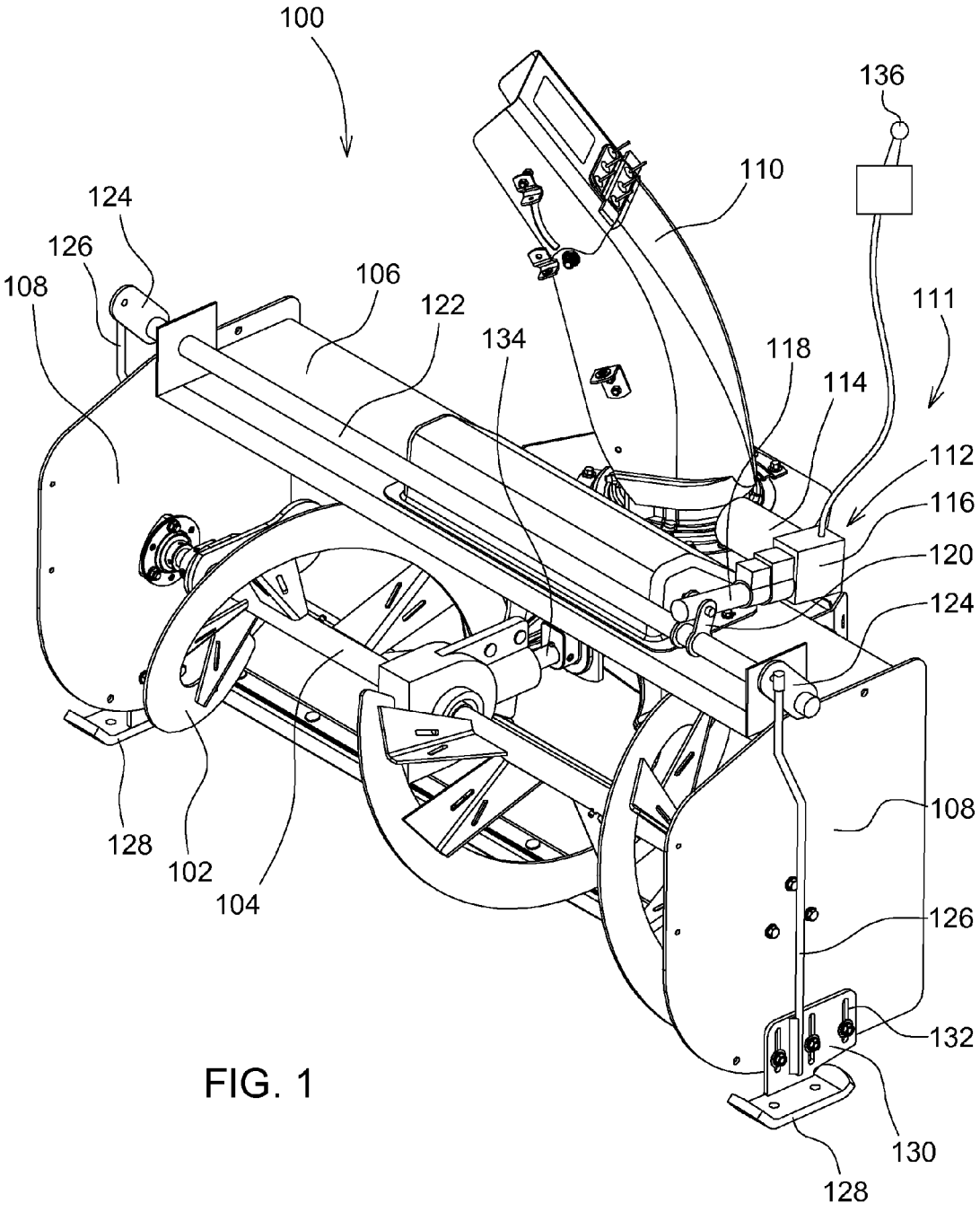
FIG. 1 is a snowblower with a skid shoe height adjustment mechanism in a first position according to a preferred embodiment of the invention.
Figure 2:
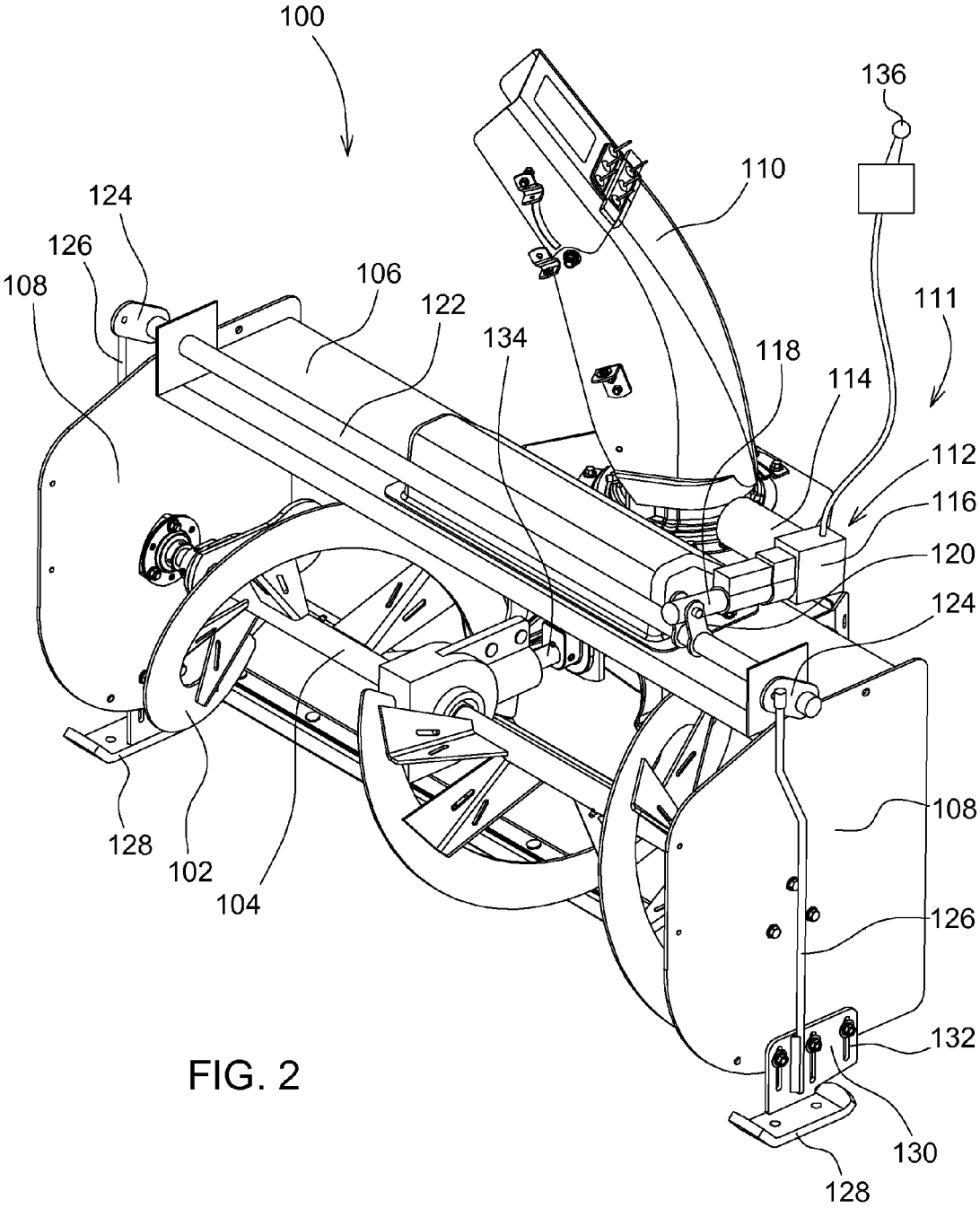
FIG. 2 is a snowblower with a skid shoe height adjustment mechanism in a second position according to a preferred embodiment of the invention.

In one embodiment shown in FIGS. 1-2, snowblower 100 may be mounted to the front of a small tractor or utility vehicle using a front hitch. The snowblower may include a metal auger 102 that rotates on horizontal shaft 104. The horizontal shaft may be connected to power take off shaft 134. The auger and shaft may be mounted in auger housing 106 having left and right sidewalls 108. After the auger breaks up and draws snow into the housing, an impeller forces the snow up and out discharge chute 110.

In one embodiment, skid shoe height adjustment mechanism 111 may be mounted on or adjacent the top surface and/or sidewalls of the auger housing. The skid shoe height adjustment mechanism may include linear actuator 112 such as a Model PA-02-2-400 linear actuator by Progressive Automations of Los Angeles, Calif. The linear actuator may include 12 VDC electric motor 114 connected to a power sources such as a storage battery, and by a gearbox housing 116 to a screw that can extend and retract a rod or plunger 118. The linear actuator may have a load capacity of at least about 200 pounds and preferably at least about 400 pounds. The linear actuator may be connected to and operated by a switch 136 in the operator station having forward and reverse positions.

In one embodiment, skid shoe height adjustment mechanism 111 may include linkages between linear actuator 112 and the pair of skid shoes 128. For example, the linkage may include bell crank 120 connecting linear actuator 112 to shaft 122, a pair of bell cranks 124 connecting the left and right ends of shaft 122 to the upper ends of left and right rods 126, and a skid shoe plate 130 secured to the lower end of each rod.

In one embodiment, the first end of bell crank 120 may be pivotably connected to the linear actuator, and the second end of bell crank 120 may be rigidly secured to shaft 122. Shaft 122 may extend transversely across the top of the auger housing between the left and right sidewalls. A pair of bell cranks 124 may connect the left and right ends of shaft 122 to left and right rods 126. The first end of each bell crank 124 may be rigidly connected to shaft 122, and the second end of each bell crank 124 may be pivotably connected to the first or upper end of one of the rods 126. Each of rods 126 may be generally vertically oriented adjacent one of the sidewalls. A vertically adjustable skid shoe plate 130 may be secured to the lower end of each rod 126. Each skid shoe plate 130 may be slidably attached to an auger housing sidewall 108 so that the skid shoe plate can slide vertically to raise and lower a skid shoe 128. For example, each skid shoe plate may have a plurality of generally vertical slots 132, and fasteners may extend from the sidewall though the slots. A skid shoe 128 may be secured to each skid shoe plate.

In one embodiment, the operator may actuate a switch to turn on linear actuator 112 to extend rod or plunger 118, or retract rod or plunger. The linear actuator is connected to bell crank 120 which turns shaft 122 and the pair of bell cranks 124 to simultaneously move rods 126 up or down and raise or lower both of the skid shoe plates and skid shoes. FIG. 1 shows the skid shoe plates and skid shoes in a first position, and FIG. 2 shows them in a second position where the snowblower is raised further up off the ground surface.

Having described the preferred embodiment, it will become apparent that various modifications can be made without departing from the scope of the invention as defined in the accompanying claims.

The invention claimed is:

1. A snowblower skid shoe height adjustment mechanism, comprising:

an auger housing having left and right sidewalls;

a linear actuator mounted to the auger housing, the linear actuator connected to a switch in an operator station to extend or retract the linear actuator;

a shaft extending transversely across the auger housing and pivoting in response to the extension or retraction of the linear actuator and having a first bell crank adjacent a left end and a second bell crank adjacent a right end of the shaft; and a non-rotating rod connected to each of the first and the second bell cranks, each rod extending generally vertically down to a skid shoe, the rods and skid shoes being translated to an operator-specified position as the linear actuator is extended or retracted.

2. The snowblower skid shoe height adjustment mechanism of claim 1 further comprising a bell crank connecting the linear actuator to the shaft.

3. The snowblower skid shoe height adjustment mechanism of claim 1 wherein each skid shoe is attached to a skid shoe plate slideably mounted to the sidewall of the auger housing.

4. A snowblower skid shoe height adjustment mechanism, comprising:

an electrically powered linear actuator mounted to an auger housing; and a linkage between the linear actuator and a pair of skid shoes adjacent a pair of sidewalls of the auger housing; the linkage including a pivoting shaft extending transversely across the auger housing connected to a pair of vertically oriented non-rotating rods that translate to an operator-specified position as the shaft pivots.

5. The snowblower skid shoe height adjustment mechanism of claim 4 further comprising an electrical switch in an operator station connected to the linear actuator.

6. The snowblower skid shoe height adjustment mechanism of claim 4 wherein the linkage further comprises a plurality of bell cranks.

7. The snowblower skid shoe height adjustment mechanism of claim 4 wherein each skid shoe is slideably mounted to a sidewall of the auger housing.

8. A snowblower skid shoe height adjustment mechanism, comprising:

a skid shoe secured to the lower end of a non-rotating rod on each side of an auger housing;

the rods linked together by a shaft having a horizontal axis so that the rods translate vertically to raise or lower the skid shoes simultaneously; and an electrical actuator to pivot the shaft on its horizontal axis to move the rods to an operator-specified position.

9. The snowblower skid shoe height adjustment mechanism of claim 8 wherein the electrical actuator is a linear actuator having an electric motor to extend or retract a rod.

10. The snowblower skid shoe height adjustment mechanism of claim 8 wherein each skid shoe is attached to a skid shoe plate having vertically oriented slots slideably mounted to a side of the auger housing.

* * * * *